US006952937B2

(12) United States Patent
Choi et al.

(10) Patent No.: US 6,952,937 B2
(45) Date of Patent: Oct. 11, 2005

(54) ICE MAKING MACHINE

(75) Inventors: Cheol-ho Choi, Gwangju (KR); Hideo Nakajo, 1186-1, Janggi-dong, Kimpo-city Gyunggi-do (KR)

(73) Assignees: Samsung Gwangju Electronics Co., Ltd., Gwangju (KR); Hideo Nakajo, Gyunggi-do (KR)

( * ) Notice: Subject to any disclaimer, the term of this patent is extended or adjusted under 35 U.S.C. 154(b) by 0 days.

(21) Appl. No.: 10/712,948

(22) Filed: Nov. 13, 2003

(65) Prior Publication Data

US 2004/0107721 A1 Jun. 10, 2004

(30) Foreign Application Priority Data

Dec. 10, 2002 (KR) ..... 10-2002-0078074

(51) Int. Cl.[7] ..... F25C 1/12
(52) U.S. Cl. ..... 62/347; 62/291; 62/352
(58) Field of Search ..... 62/347, 348, 352, 62/285, 291

(56) References Cited

U.S. PATENT DOCUMENTS 2,648,956 A * 8/1953 Fletcher et al. ..... 62/73
2,921,447 A * 1/1960 Gottschalk ..... 62/139
4,338,794 A * 7/1982 Haasis, Jr. ..... 62/348
5,025,641 A * 6/1991 Broadhurst ..... 62/347
5,484,538 A * 1/1996 Woodward ..... 210/767
5,987,900 A * 11/1999 Love ..... 62/66
6,532,758 B2 * 3/2003 DuHack ..... 62/340
6,647,739 B1 * 11/2003 Kim et al. ..... 62/352

* cited by examiner

*Primary Examiner*—William E. Tapolcai
(74) *Attorney, Agent, or Firm*—Ladas & Parry LLP

(57) ABSTRACT

An ice making machine having a main body and an auxiliary table which is separable from the main body, wherein the main body of the ice making machine comprises a freezing unit for making ice pieces by freezing water separated into discrete cells; a cooling system connected to the freezing unit; an ice bin for storing ice pieces made by the freezing unit; a first water supply pipe for supplying water to the freezing unit; and a first drain pipe for discharging water remaining unfrozen in the freezing unit. The auxiliary table comprises a feed water receptacle and a drain receptacle, both having a space for containing a predetermined level of water; a second water supply pipe selectively connected to the first water supply pipe to supply water contained in the feed water receptacle to the freezing unit; and a second drain pipe selectively connected to the first drain pipe to direct water discharged from the freezing unit to flow to the drain receptacle. The first water supply pipe and first drain pipe of the main body can be selectively and respectively connected to an external water line for supplying water and an external drainage for discharging water remaining unfrozen in the freezing unit.

10 Claims, 7 Drawing Sheets

ICE MAKING MACHINE

BACKGROUND OF THE INVENTION

1. Field of the Invention

The present invention relates generally to ice making machines, and more particularly to an ice making machine having a feed water receptacle and a drain receptacle within a housing thereof so that it can be installed any where that is desired, irrespective of availability of a water source.

2. Description of the Related Art

As is generally known in the art, an ice making machine is used to make ice by freezing water supplied to the machine from an external source. FIG. 1 illustrates a conventional ice making machine, such as that disclosed in U.S. Pat. No. 5,425,243.

As shown in FIG. 1, the conventional ice making machine comprises a housing 10 and a freezing unit 20.

The housing 10 includes an ice bin 11 disposed therein to store ice pieces formed in the freezing unit 20. A cooling system 30 including a compressor 31 and a condenser 32 is provided below the ice bin 11. A water supply pipe 12 for supplying water to the freezing unit 20 and a drain pipe 13 for discharging unfrozen water to the outside of housing 10 are connected to the housing 10. The water supply pipe 12 extends and is connected to the freezing unit 20 from an external water supply line (not shown). The drain pipe 13 extends and is connected to an external drainage (not shown) from a water collecting section 14 disposed in the ice bin 11.

As shown in FIG. 2, the freezing unit 20 includes a water tray 21, a freezing base plate 22 and an evaporator 23. The water tray 21 is coupled to a supporting member 25 pivotably supported by a pivotal shaft 24. Preferably, the water tray 21 has a rocking plate 26 therein. The supporting member 25 pivots on the pivotal shaft 24 and is controlled by the rotation of an actuator motor AM so that the water tray 24 can be tilted downward at a predetermined angle to discharge any unfrozen water remaining therein. The rocking plate 26 is rocked upward and downward by the rotation of a rocking motor RM, thereby rocking the water contained in the water tray 21 and removing any air bubbles that may be present in the water. Also, a water chute 27 is integrally formed at the bottom of the water tray 21 to deliver the water discharged from the water tray 21 to the water collecting section 14.

A plurality of freezing fingers 28 protrude downwardly from the lower surface of the freezing base plate 22 and are used for dipping in the water carried in the water tray 21 so as to form and gradually grow ice pieces around them.

The evaporator 23 is formed on the upper surface of the freezing base plate 22 and is connected to the cooling system 30. Compressed refrigerant flows into the evaporator 23 and carries out a heat exchange process so as to cool the freezing base plate 22 and the freezing fingers 28.

Hereinafter, the operation of a conventional ice making machine having the above-mentioned structure will be explained in more detail with reference to FIGS. 1 and 2.

When water is supplied to the water tray 21 through the water supply pipe 12, the freezing fingers 28 are dipped into the water and are then cooled to a temperature below the freezing point by the heat exchange process with the refrigerant flowing into the evaporator 23 so that the water in the tray 21 will be frozen to form ice pieces around the freezing fingers 28. At this time, the rocking motor RM rotates to rock the rocking plate 26 in the upward and downward directions, thereby removing any air bubbles that may be present in the water.

Upon completion of the formation of the ice pieces having a predetermined size around the freezing fingers 28, the rocking plate 26 stops its rocking motion. Also, the refrigerant, after warming from its freezing function, is discharged directly from the compressor 31, without going through the condenser 32, and is supplied to the evaporator 23 to slightly heat up and thereby release the ice pieces from the freezing fingers 28 into the ice bin 11. The water tray 21 is then tilted, together with the supporting member 25, by the rotation of the actuator motor AM. Accordingly, any water remaining unfrozen in the water tray 21 flows along the water chute 27 and is discharged into the water collecting section 14.

However, such a conventional ice making machine can only be located at places where it can be connected to an external water supply line for supplying water to the freezing unit and where drainage for discharging a great amount of unfrozen water is available.

SUMMARY OF THE INVENTION

Accordingly, the present invention has been made to solve the above-mentioned problems occurring in conventional ice making machines, and an aspect of the present invention is to provide an ice making machine which is designed to require less supply and discharge of water and to include a feed water receptacle and a drain receptacle, which may take the form of buckets, within a housing thereof so that it can continuously operate for several days, without the need to be managed by an operator, and can be installed at any place, even where a direct water supply line or drainage are not readily available.

In order to accomplish the above aspect and/or other features of the present invention, there is provided an ice making machine comprising a main body and an auxiliary table which is separable from the main body. The main body of the ice making machine comprises a freezing unit for making ice pieces by freezing water; a cooling system connected to the freezing unit; an ice bin for storing ice pieces made by the freezing unit; a first water supply pipe for supplying water to the freezing unit; and a first drain pipe for discharging water remaining unfrozen in the freezing unit. The auxiliary table comprises a feed water receptacle and a drain receptacle, both having space for containing a predetermined level of water; a second water supply pipe selectively connected to the first water supply pipe to supply water contained in the feed water receptacle to the freezing unit; and a second drain pipe selectively connected to the first drain pipe to direct water discharged from the freezing unit to flow to the drain receptacle. The first water supply pipe and first drain pipe of the main body can be selectively and respectively connected to an external water line for supplying water and an external drainage for discharge of water remaining unfrozen in the freezing unit.

Preferably, the feed water receptacle and the drain receptacle take the form of open top buckets that can be separated from the auxiliary table.

Preferably, the ice making machine according to the present invention includes a water supply pump for forcing water contained in the feed water receptacle to flow into the freezing unit; a flow sensor for detecting the flow of water being supplied to the freezing unit; and a controller for controlling the water supply pump in response to a signal from the flow sensor.

It is preferable to provide a water supply valve between the water supply pump and the feed water receptacle in order to selectively block the flow of water that is being supplied from the feed water receptacle.

It is also preferable to provide a water purifier between the freezing unit and the feed water receptacle and a sterilizing light on the water flow path between the freezing unit and the water purifier.

The freezing unit includes an evaporation tube connected to the cooling system; a base frame having a plurality of freezing cells to be filled with water and pivotably mounted in the main body; a freezing plate having freezing fingers for dipping into the water supplied to the freezing cells to form ice pieces therearound; and a drain leading path formed at one side of the base frame. Preferably, the base frame is capable to pivot and tilt to one side so that water remaining unfrozen in the freezing cells can be discharged to the drain receptacle along the drain leading path.

A drain leading means can be provided at one side of the ice bin to receive water flowing along the drain leading path and delivering the water to the drain receptacle. The drain leading means should preferably include a tube section connected to the drain receptacle and a diverging section for leading the water flowing down from the drain leading member to the tube section.

Also, it is preferable to provide a connection pipe connected to the drain receptacle within the ice bin to make the water melted in the ice bin flow into the drain receptacle through the connection pipe.

In accordance with another aspect of the present invention, there is provided an ice making machine comprising: a housing; a freezing unit received in the housing to make pieces of ice by freezing water; a cooling system connected to the freezing unit; an ice bin for storing the ice pieces made by the freezing unit; a feed water receptacle received in the housing to supply water stored therein to the freezing unit; and a drain receptacle received in the housing to store water that remains unfrozen and is discharged from the freezing unit.

Preferably, the feed water receptacle and the drain receptacle can be separated from the housing.

BRIEF DESCRIPTION OF THE DRAWINGS

The above aspects and other advantages of the present invention will be made more apparent from the following detailed description taken in conjunction with the accompanying drawings, in which.

DETAILED DESCRIPTION OF THE PREFERRED EMBODIMENTS

Hereinafter, preferred embodiments of the present invention will be described in detail with reference to the accompanying drawings.

Figure 3:
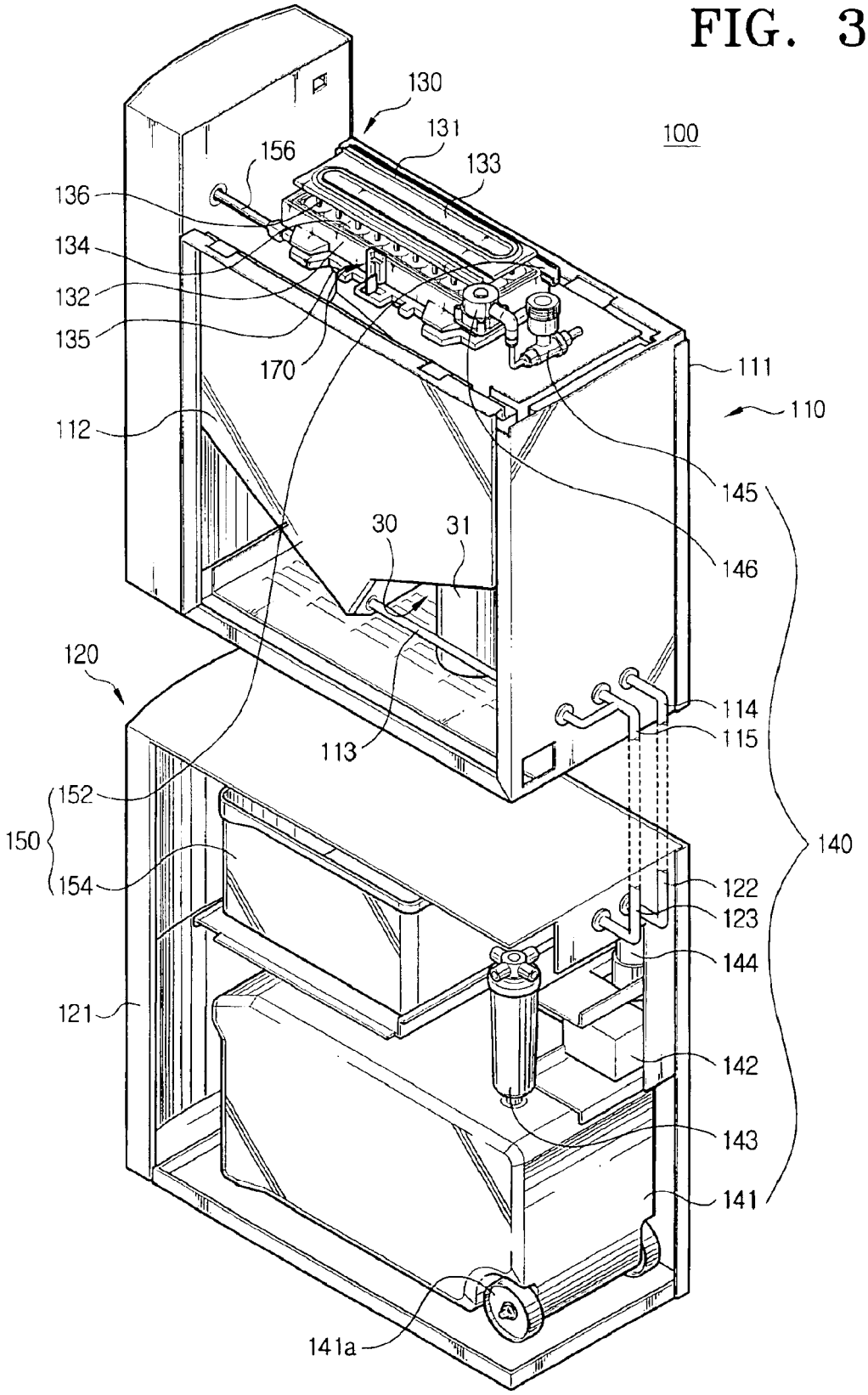
FIG. 3 is a perspective view of an ice making machine according to a first embodiment of the present invention.

As illustrated in FIG. 3, an ice making machine 100 according to the first embodiment of the present invention is comprised of a main body 110 and an auxiliary table 120 separably connected to the main body 110. More specifically, the ice making machine 100 comprises an upper housing 111 for receiving the main body 110, a lower housing 121 for receiving the auxiliary table 120, a freezing unit 130 for making ice by freezing supplied water, a water supply system 140 for supplying water to the freezing unit 130 and a drain system 150 for discharging water remaining in the freezing unit 130.

Figure 1:
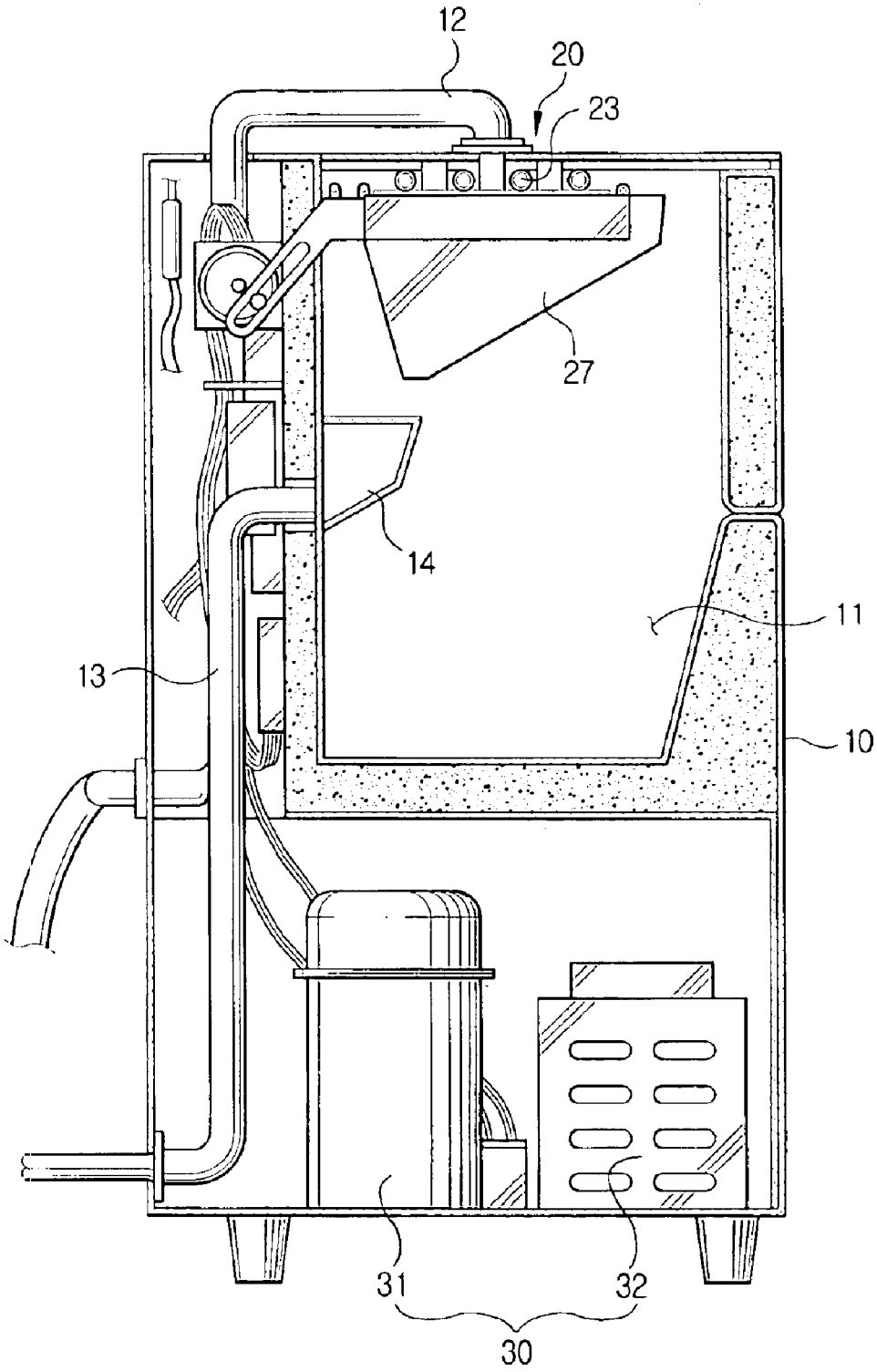
FIG. 1 (PRIOR ART)
FIG. 1 is a cross-sectional view briefly showing the structure of a conventional ice making machine.
Figure 2:
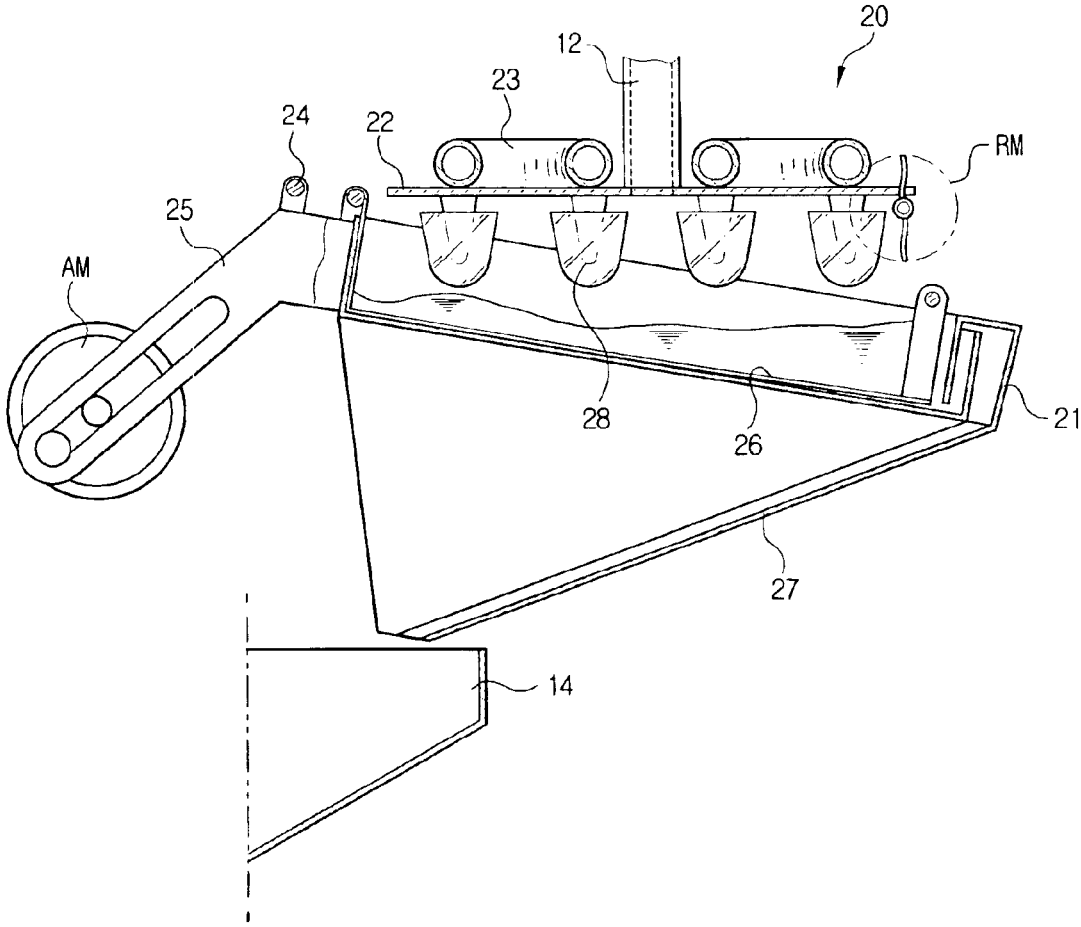
FIG. 2 (PRIOR ART)
FIG. 2 is a cross-sectional detail view of a freezing unit of the conventional ice making machine of FIG. 1.

The upper housing 111 contains a cooling system 30 including a compressor 31 and a condenser 32, as in the conventional ice making machine illustrated in FIG. 1. The upper housing 111 also includes a freezing unit 130 for making ice from supplied water and an ice bin 112 for storing the ice pieces made by the freezing unit 130. The lower housing 121 contains a feed water receptacle 141 and a drain receptacle 154. The ice bin 112 is connected to the drain receptacle 154 through a connection pipe 113.

A first water supply pipe 114 and a first drain pipe 115 are connected to the upper housing 111, while a second water supply pipe 122 and a second drain pipe 123 are connected to the lower housing 121. The upper housing 111 is mounted over the lower housing 121. The first water supply pipe 114 and the first drain pipe 115 are preferably connected, respectively, to the second water supply pipe 122 and the second drain pipe 123, as shown by the dotted lines.

Figure 4:
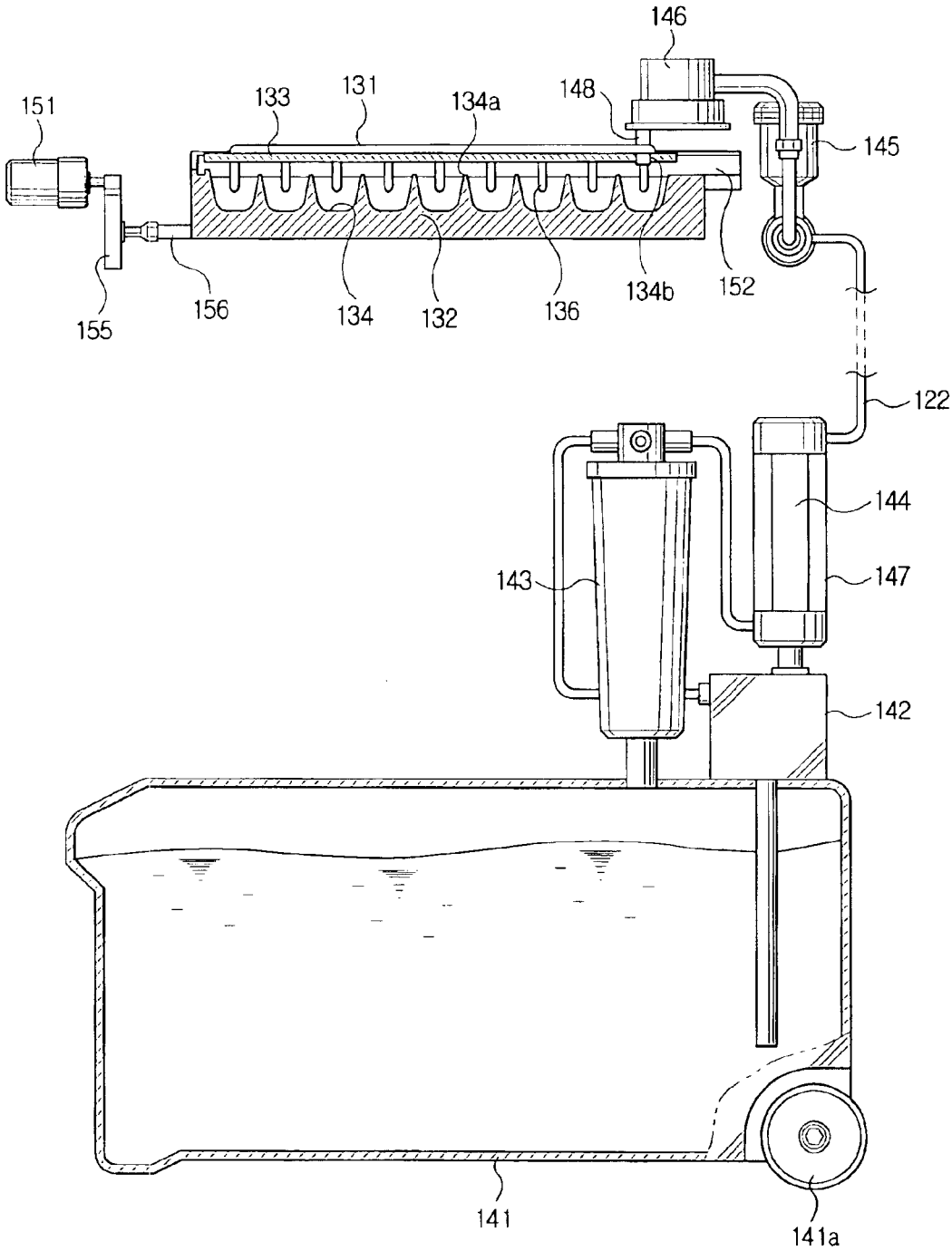
FIG. 4 is a cross-sectional detail view of a water supply system of the ice making machine of FIG. 3.

As shown in FIGS. 3 and 4, the freezing unit 130 comprises an evaporation tube 131, a base frame 132 and a freezing plate 133.

The evaporating tube 131 is connected to the cooling system 30 and is and partially inserted into a groove 133*a* (FIG. 5) formed on the freezing plate 133. Refrigerant flows into the evaporating tube 131 and carries out a heat exchange process so as to cool the evaporating tube 131, and the water supplied to the base frame 132.

The base frame 132 has a plurality of freezing cells 134 which will be filled with water, and the base frame 132 also can be tilted to one side. More specifically, the base frame 132 can swing downwardly at an angle of 90° on a pivotal shaft 135. The freezing cells 134 preferably are formed having the same size and an appropriate number in consideration of the capacity of the cooling system 30. Each freezing cell 134 partially overlaps adjacent freezing cells in such a way that an intersection 134*a* can be formed at the overlapping portion of the freezing cells 134 to serve as a path for water flow therebetween. The height of the intersection 134*a* is predetermined to provide ice pieces of a desired size.

The freezing plate 133 includes the evaporating tube 131 on the upper surface thereof. A plurality of freezing fingers 136, which are formed and configured to be dipped into the water filled in the freezing cells 134 of the base frame 132, extend from the lower surface of the freezing plate 133. The freezing fingers 136 are cooled to a temperature below the freezing point of water by the heat exchange process with the refrigerant flowing into the evaporating tube 131 so that the water will be frozen to form ice pieces around the freezing fingers 136.

The water supply system 140 (FIG. 3) preferably includes a feed water receptacle 141, a water supply pump 142, a water purifier 143, a sterilizing light 144, a water supply valve 145 and a flow sensor 146, as shown in FIG. 4.

The feed water receptacle 141 for storing water to be supplied to the freezing cells 134 is placed within the lower housing 121. When the feed water receptacle 141 runs out of water, an operator separates the feed water receptacle 141 from the lower housing 121 and refills it with water. Since the feed water receptacle 141 refilled with water will be heavy, it is provided with a pair of moving wheels disposed underneath thereof so as to be easily handled by the operator.

Figure 6:
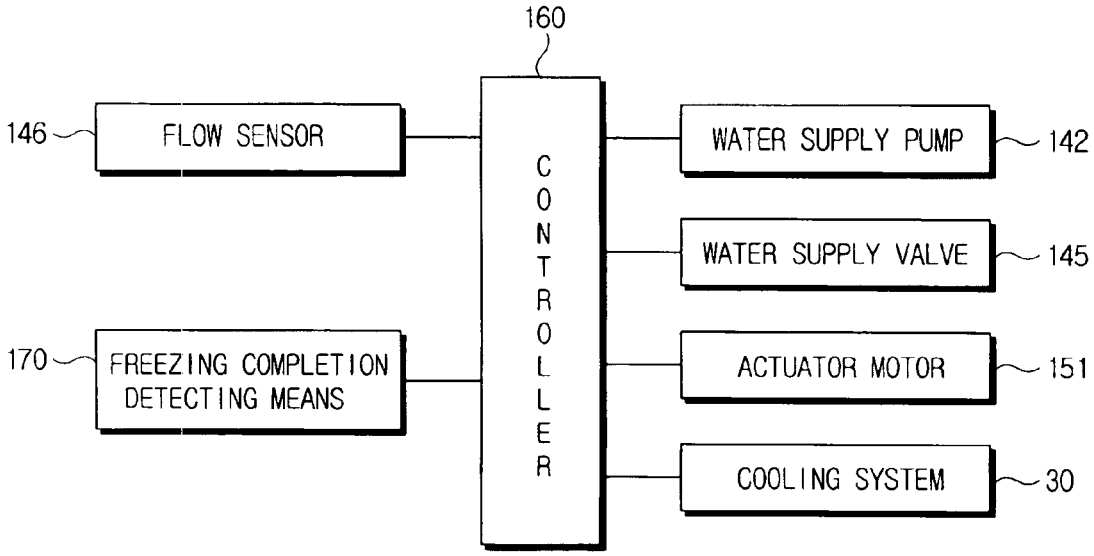
FIG. 6 is a block diagram showing the organization of an ice making machine according to the first embodiment of the present invention.

The water supply pump 142 is connected to the feed water receptacle 141 to enable it to force the water contained in the feed water receptacle 141 to flow into the freezing cells 134. The water pumped out from the feed water receptacle 141 by the water supply pump 142 is purified during the course of passing through the water purifier 143 and across the sterilizing light 144. The sterilizing light 144 is located inside a waterproof tube 147 (FIG. 4). The water passing through the water purifier 143 flows between the tube 147 and the sterilizing light 144 and moves to the water supply valve 145. After going through the flow sensor 146, the water is then supplied to each freezing cell 134 of the base frame 132 through a water supply tube 148. The flow sensor 146 detects the flow of the water supplied to the freezing cells 134 through the water supply tube 148. When the detected flow reaches the amount that is required to fill the freezing cells 134 of the base frame 132, the flow sensor 146 sends a signal to a controller 160 (FIG. 6), which will then generate a shut off of the water supply valve 145. The water supply tube 148 is inserted into a penetration hole 134*b* formed at one end of the freezing plate 133, with its end being spaced at a predetermined distance from the freezing cells 134 of the base frame 132.

Figure 5:
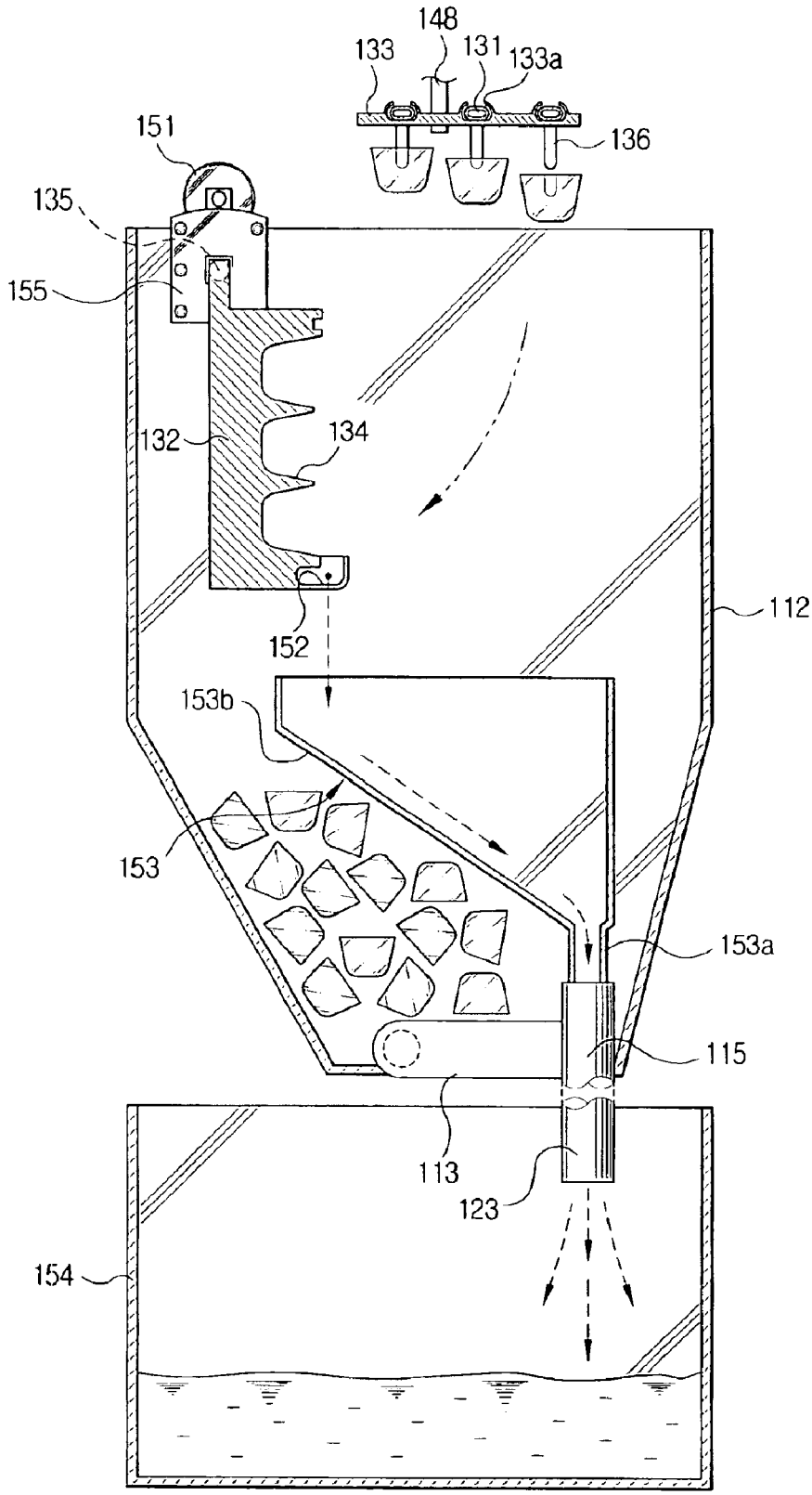
FIG. 5 is a cross-sectional view of a drain system of the ice making machine of FIG. 3.

The drain system 150 (FIGS. 3 and 4) includes an actuator motor 151, a drain leading path 152, a drain leading means 153 (FIG. 5) and a drain receptacle 154, as shown in FIG. 5.

As a means for tilting the base frame 132 to one side, the actuator motor 151 is connected to the base frame 132 through a gear box 155 and a pivot 156 (FIG. 4). When the actuator motor 151 is driven, the driving force is transferred to the pivot 156 through the gear box 155 so that the base frame 132 connected to the pivot 156 will swing downwardly at an angle of about 90° on the pivotal shaft 135 (FIG. 3).

When the base frame 132 is in the downwardly extending discharge position, as shown in FIG. 5, the drain leading path 152 formed at one end of the base frame 132 guides the water remaining unfrozen in the freezing cells 134 to the drain leading means 153. When the base frame 132 is tilted by the rotation of the actuator motor 151 to drop the ice pieces formed around freezing fingers 136, the water remaining in each freezing cell 134 flows into the drain leading member 153 along the drain leading path 152.

The drain leading member 153, located at one side within the ice bin 112, receives the water dripping from the drain leading path 152 and leads the water to flow completely into the drain receptacle 154. The drain leading member 153 is composed of a tube section 153*a* and a diverging section 153*b*. The tube section 153*a* is connected to the drain receptacle 154 to lead the water dripping into the diverging section 153*b* to flow only into the drain receptacle 154. The diverging section 153*b* is formed having a funnel shape with a wide inlet to receive water from the drain leading path 152, wherever located, and to lead the water to flow into the tube section 153*a*.

The drain receptacle 154 located below the freezing unit 130 stores water discharged from each freezing cell 134 of the base frame 132. When the drain receptacle 154 is full of water, the operator should remove it from the lower housing 121, pour out the water and reinsert the empty receptacle 154 back into the lower housing 121.

The operation of the ice making machine according to the present invention will be explained in more detail with reference to FIGS. 3 to 6.

When the water supply pump 142 operates, it forces the water carried in the feed water receptacle 141 to be directed to the freezing cells 134. The water pumped out from the feed water receptacle 141 passes through the water purifier 143 and the tube 147 having the sterilizing light 144 disposed therein. Any impurities or bacteria contained in the water are removed during the course of passing through the water purifier 143 and the tube 147. The purified water then moves to the water supply valve 145 via the second water supply pipe 122 and the first water supply pipe 114. The water passes through the flow sensor 146 and is supplied to the freezing cells 134 through the water supply tube 148. When one freezing cell 134 is filled with water to overflowing, adjacent freezing cells 134 become filled one by one with water delivered through the intersections 134*a* formed at the overlapping portions of adjacent freezing cells 134.

When the amount of water passing through the flow sensor 146 is sufficient to fill all the freezing cells 134 of the base frame 132, the flow sensor 146 sends a signal to the controller 160. Upon receiving the signal, the controller 160 controls the water supply valve 145 to block the flow of water and stops the operation of the water supply pump 142. Accordingly, it is possible to introduce an appropriate amount of water into the freezing cells 134 to be frozen to make ice pieces.

When the freezing cells 134 are filled with water, the controller 160 operates the cooling system 30, thereby making refrigerant flow into the evaporation tube 131 of the freezing unit 130. At the same time, the controller 160 continues the freezing operation by rocking the base frame 132 up and down so as to form transparent ice pieces without air bubbles. The freezing plate 133 and the freezing fingers 136 are cooled to a temperature below the freezing point by heat exchange with the refrigerant flowing into the evaporation tube 131 so that the water will be gradually frozen to form and grow ice pieces around the freezing fingers 136.

A freezing completion detecting means 170 detects when the freezing operation is completed and sends a corresponding signal to the controller 160. Upon receiving the signal, the controller 160 controls the cooling system 30 so that heated refrigerant will be delivered to the evaporation tube 131 directly from the compressor 31, without first going through the condenser 32 (see FIG. 1). At the same time, the actuator motor 151 is driven to make the base frame 132 pivot around the pivotal shaft 135. The base frame 132 is tilted downwardly to a substantially vertical position so that any water remaining unfrozen in the freezing cells 134 can flow through the drain leading path 152 and fall down into the diverging section 153*b* of the drain leading means 153. After passing through the tube section 153*a* of the drain leading means 153, the water falls into the drain receptacle 154 via the first and second drain pipes 115 and 123.

In the ice making machine 100 according to the first embodiment of the present invention, the main body 110 can be separated from the auxiliary table 120 and can be independently used when connected to an external water line and drainage for supplying and discharging water.

Figure 7:
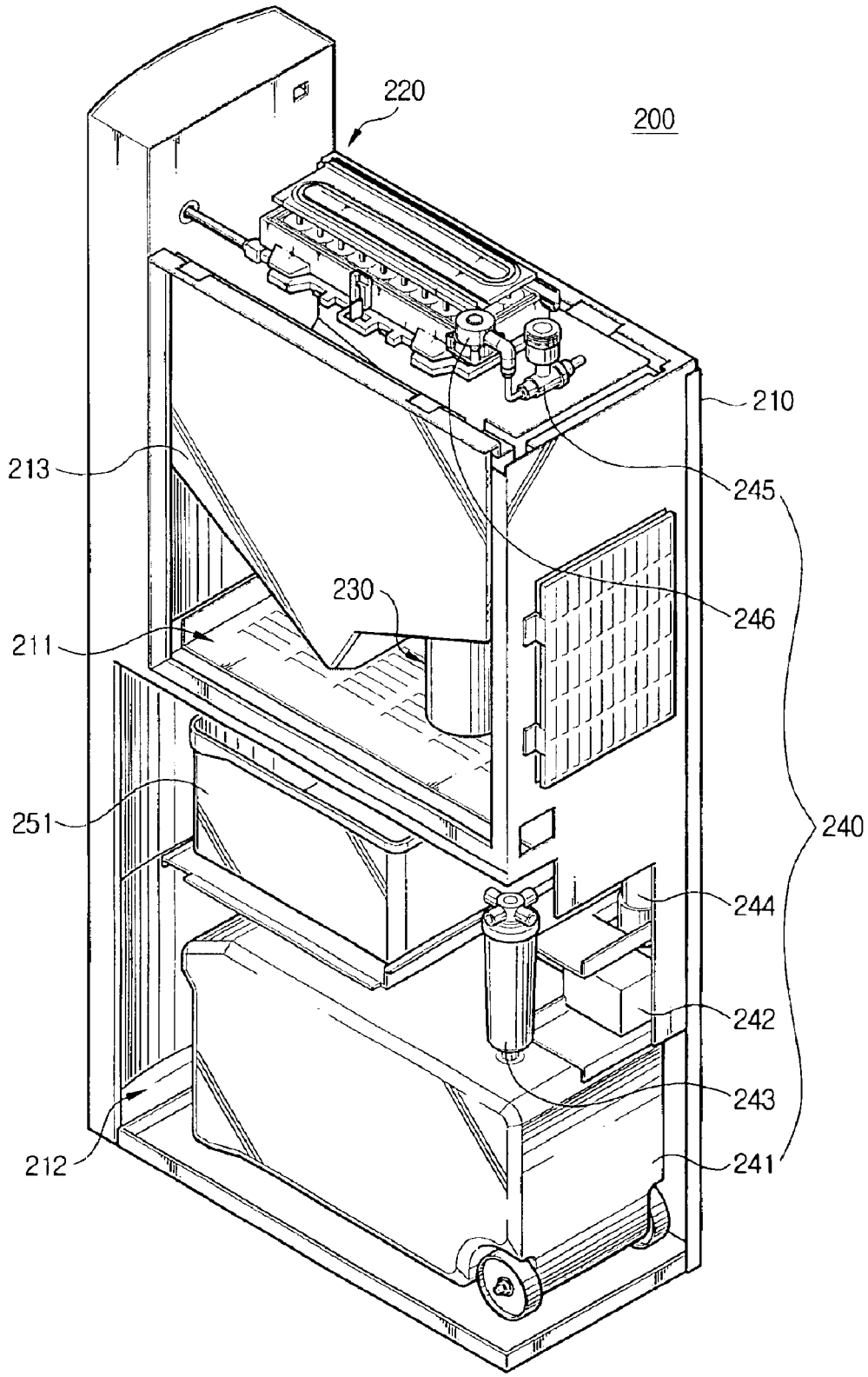
FIG. 7 is a perspective view of an ice making machine according to a second embodiment of the present invention.

FIG. 7 shows another ice making machine according to a second embodiment of the present invention.

As shown in FIG. 7, an ice making machine 200 according to the second embodiment is similar in structure to the ice making machine 100, according to the first embodiment. However, the ice making machine 200 is different in that it has a freezing unit 220, a cooling system 230, a water supply system 240 and a drain system 260, all disposed in a single housing 210 having upper and lower chambers 211 and 212 therein.

The upper chamber 211 includes the freezing unit 220 for forming ice by freezing supplied water, the cooling system 230 connected to the freezing unit 220 and an ice bin 213 for storing ice pieces formed by the freezing unit 220.

The lower chamber 212 comprises the water supply system 240, which includes a feed water receptacle 241, a water supply pump 242, a water purifier 243 and a sterilizing light 244. The lower chamber 212 also includes the drain system, including a drain receptacle 251.

The water carried in the feed water receptacle 241 is pumped out by the water supply pump 242 and is supplied to the freezing unit 220, passing through the water purifier 243, the sterilizing light 244, a water supply valve 245 and a water flow sensor 246. The water remaining unfrozen in the freezing unit 220 falls down into the drain receptacle 251 of the lower chamber 212, similar to that of the first embodiment of the ice making machine 100.

Since the other parts of the ice making machine 200 are similar or identical to those of the ice making machine 100, as illustrated in FIG. 3, no additional description will be provided herein in respect of those parts.

According to the preferred embodiments of the present invention, the ice making machine supplies water only in an appropriate amount required to fill a plurality of freezing cells 134 having a predetermined size. Thus, the ice making machine requires less supply of water to form ice pieces and less discharge of unfrozen water. In other words, the ice making machine can smoothly supply and discharge water using only the feed water receptacle 141 and drain receptacle 154 disposed therein.

As described above, the present invention provides both the feed water receptacle 141 for supplying water to the freezing unit 130 and the drain receptacle 154 for storing unfrozen water discharged from the freezing unit 130 within the main body 110 of the ice making machine. Therefore, the ice making machine of the present invention is not restricted with respect to the place of installation thereof, as compared to a conventional ice making machine, which should be installed only in a place having an external water supply utility and drainage.

Also, the ice making machine of the present invention supplies water only in the appropriate amount required to fill a plurality of freezing cells 134 of the freezing unit 130, thereby reducing the amount of discharged unfrozen water, thereby preventing waste of water.

Although preferred embodiments of the present invention have been described for illustrative purposes, those skilled in the art will appreciate that various modifications, additions and substitutions are possible, without departing from the scope and spirit of the invention as recited in the accompanying claims.

What is claimed is:

1. An ice making machine comprising a main body and an auxiliary table which is separable from the main body, said main body comprising: a freezing unit for making ice pieces by freezing water; a cooling system connected to the freezing unit; an ice bin for storing ice pieces made by the freezing unit; a first water supply pipe for supplying water to the freezing unit; and a first drain pipe for discharging water remaining unfrozen in the freezing unit, said auxiliary table comprising; a feed water receptacle and a drain receptacle, both having space for containing a predetermined level of water; a second water supply pipe selectively connected to the first water supply pipe to supply water contained in the feed water receptacle to the freezing unit; and a second drain pipe selectively connected to the first drain pipe to direct water discharged from the freezing unit to flow to the drain receptacle, wherein the first water supply pipe and first drain pipe of said main body can be selectively and respectively connected to an external water line for supplying water and an external drainage for discharge of water remaining unfrozen in the freezing unit.

2. The ice making machine according to claim 1, wherein said feed water receptacle and said drain receptacle can be separated from said auxiliary table.

3. The ice making machine according to claim 1, further including:

a water supply pump for forcing water contained in the feed water receptacle to flow into the freezing unit;

a flow sensor for detecting the flow of water being supplied to the freezing unit; and a controller for controlling the water supply pump in response to a signal from the flow sensor.

4. The ice making machine according to claim 3, further including a water supply valve provided between the water supply pump and the feed water receptacle to selectively block the flow at water which is being supplied from the feed water receptacle.

5. The ice making machine according to claim 1, further including a water purifier provided between the freezing unit and the feed water receptacle.

6. The ice making machine according to claim 5, further including a sterilizing light provided on the water flow path between the freezing unit and the water purifier.

7. The ice making machine according to claim 1, wherein said freezing unit includes:

an evaporation tube connected to the cooling system;

a base frame having a plurality of freezing cells to be filled with water and pivotably mounted in the main body;

a freezing plate having freezing fingers for dipping into the water supplied to the freezing cells to form ice pieces therearound; and a drain leading path formed at one side of the base frame, said base frame being capable of pivoting and tilting to one side so that water remaining unfrozen in the freezing cells can be discharged to the drain receptacle along the drain leading path.

8. The ice making machine according to claim 7, providing a drain leading means at one side of the ice bin to receive water flowing along the drain leading path and delivering the water to the drain receptacle.

9. The ice making machine according to claim 8, wherein said drain leading means includes a tube section connected to the drain receptacle and a diverging section for leading the water flowing down from the drain leading member to the tube section.

10. The ice making machine according to claim 1, wherein said ice bin has a connection pipe therein to be connected to the drain receptacle so that the water melted in the ice bin can flow into the drain receptacle through the connection pipe.

* * * * *